US008845093B1

(12) United States Patent
Shieh

(10) Patent No.: US 8,845,093 B1
(45) Date of Patent: Sep. 30, 2014

(54) CORRECTIVE LENS FOR DIVING MASK

(71) Applicant: Steve Shieh, New Taipei City (TW)

(72) Inventor: Steve Shieh, New Taipei City (TW)

( * ) Notice: Subject to any disclaimer, the term of this patent is extended or adjusted under 35 U.S.C. 154(b) by 0 days.

(21) Appl. No.: 14/023,685

(22) Filed: Sep. 11, 2013

(51) Int. Cl.
*G02C 1/00* (2006.01)
*B63C 11/12* (2006.01)

(52) U.S. Cl.
CPC ..... *B63C 11/12* (2013.01)
USPC ..... 351/43; 2/441

(58) Field of Classification Search
CPC ..... G02C 7/088; A61F 2/1602
USPC ..... 351/43, 47, 48, 57, 58, 41; 2/441, 13, 2/426, 427, 428
See application file for complete search history.

(56) References Cited

U.S. PATENT DOCUMENTS 3,051,957 A * 9/1962 Chan ..... 2/428
7,699,462 B2 * 4/2010 Godoy ..... 351/43

* cited by examiner

*Primary Examiner* — Hung Dang
(74) *Attorney, Agent, or Firm* — Muncy, Geissler, Olds & Lowe, P.C.

(57) ABSTRACT

A corrective lens for diving masks is revealed. The corrective lens for diving masks includes a corrective lens body locked on a frame of a diving mask by a locking part. Thus the corrective lens body is stacked over a surface on one side of the lens of the diving mask for improving users' vision. Moreover, the corrective lens body can be rotated horizontally in relative to the surface of the lens of the diving mask for position adjustment and vision correction. Thus the corrective lens for diving masks features on simple structure and convenience of use.

17 Claims, 6 Drawing Sheets

CORRECTIVE LENS FOR DIVING MASK

BACKGROUND OF THE INVENTION

The present invention relates to corrective lenses for diving masks, especially to corrective lenses for diving masks stacked over and arranged at a surface on one side of a lens of a diving mask for improving underwater vision.

According to users' needs, the diving mask is bonded with a pair of corrective lenses used to treat myopia, hyperopia, presbyopia, etc. Thus users/divers can see clearly underwater. Diving mask manufacturers provides a mask faceplate and a plurality sets of corrective lenses for vision correction. Thus users can select and install lenses directly into the mask faceplate according to their needs. However, specific tools are required for installation or replacement of the corrective lenses. Moreover, the operation of the specific tools follows instructions of manufacturers for preventing the lenses or the frame from being damaged. Once the user doesn't have sufficient experience in using the specific tools, there is a risk to damage the diving mask (is easy to get damaged). Moreover, the water tightness between the frame and the lenses is weakened after being assembled or replacing lenses. There is a risk of water leakage.

Refer to U.S. Pat. No. 7,699,462, a scuba diving mask with corrective lenses is revealed. The shortcoming of the device is in that the lenses of a scuba diving mask are replaced by corrective lenses. The corrective lenses are mounted on a frame detachably. There is still loss of water tightness of the mask. In order to improve the water tightness, the cost is increased. Moreover, refer to a product "Magnifier lens Assay Fresnel lens with the frame of bio-metal mask" in a catalogue of a Japanese Co. Apollo. A corrective lens is pivotally connected to a top surface of a diving mask frame. The corrective lens on the front side of the frame can be rotated vertically in relative to the frame. When the corrective lens is rotated downward to be in front side of the frame, it is used for better vision. The disadvantage of the product is in that the arrangement way of the corrective lens increases water resistance. This result in rotation and displacement of the frame the user wears. Moreover, such design has been applied to sunglasses broadly. Thus its patentability is concerned.

SUMMARY OF THE INVENTION

Therefore it is a primary object of the present invention to provide corrective lenses for diving masks with simple structure. Thus no specific tool is required to install the corrective lenses and water tightness of the diving mask is not affected by the use of the corrective lenses. Therefore the corrective lenses have convenience of use, easy manufacturing and lower cost. The users' requirements are satisfied.

In order to achieve the above object, a corrective lens for diving masks of the present invention includes at least one corrective lens body and a diving mask. At least one locking part is disposed on an edge of the corrective lens body. The diving mask consists of at least one lens, a frame for mounting the lens and a mask arranged at the frame. A periphery of the frame of the diving mask is arranged with a plurality of locked parts each of which is corresponding to and locked with the locking part of the corrective lens body. By the locking part and the locked part being locked with each other, the corrective lens body is stacked over a surface on one side of the lens of the diving mask such as a front surface or a rear surface conveniently and firmly (from the diver's point of view). For users, the corrective lens for diving masks is convenient in use.

Moreover, the corrective lens body and the locking part arranged thereof are pivotally connected to each other. Thus the corrective lens body can be operated and rotated horizontally in relative to the surface of the lens of the diving mask for adjusting position of the corrective lens body and correcting vision of users.

DETAILED DESCRIPTION OF THE PREFERRED EMBODIMENT

Figure 1:
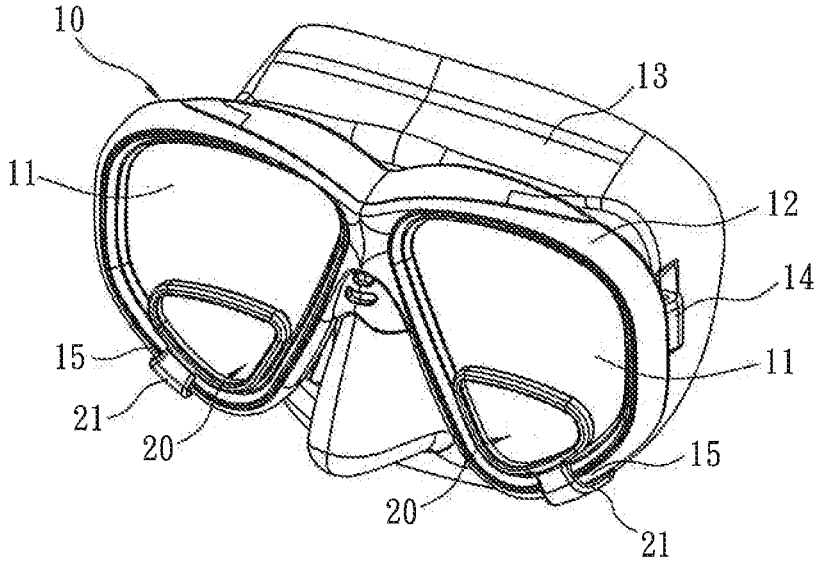
FIG. 1 is a perspective view of an assembled embodiment of corrective lenses for diving masks according to the present invention.

As shown in FIG. 1 to FIG. 11, a corrective lens for diving masks of the present invention includes a diving mask 10 and two corrective lens bodies 20. The diving mask 10 consists of lenses 11, a frame 12 for mounting the lenses 11 and a mask 13 arranged at the frame 12. Each of two sides of the frame 12 is disposed with a connection part 14 for being connected to a diving mask strap (not shown in figure) so as to fix the diving mask 10 on a user's head. The mask 13 is in contact with the user's face for protecting the user from the water outside. The number of the lens 11 can be one (such as single lens) or two (such as twin lens). In this embodiment, a twin lens with two lenses 11 is used but not limited to the twin lens. The corrective lens body 20 is arranged at a surface on one side of the lens 11 of the diving mask 10 such as an inner surface or an outer surface for the user's eye to function properly.

The First Embodiment

Figure 2:
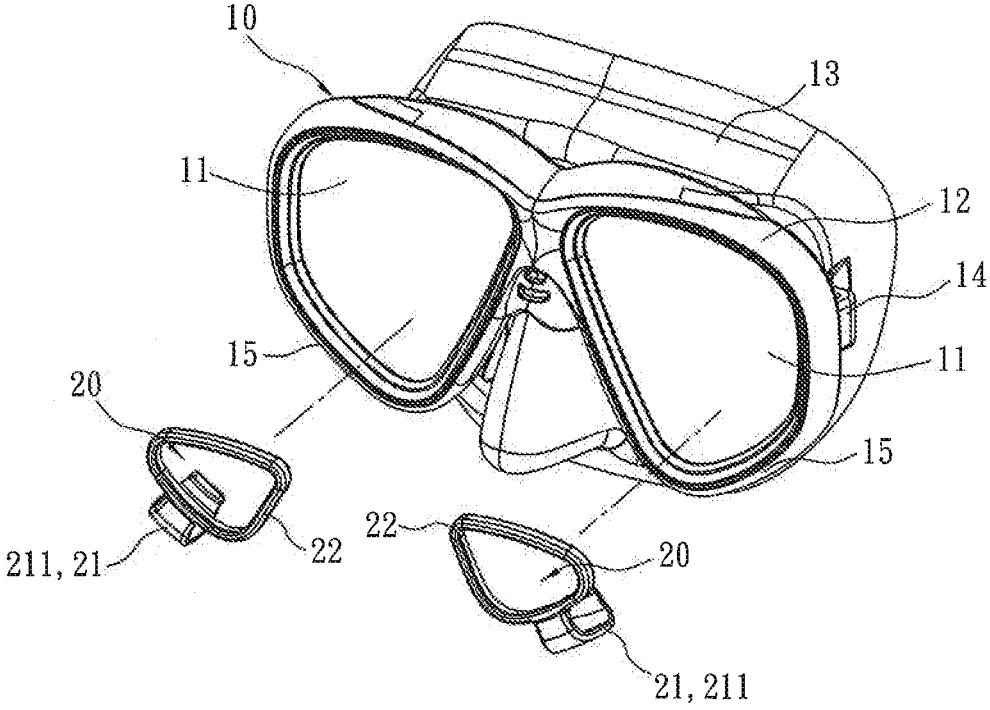
FIG. 2 is an explosive view of the embodiment in FIG. 1.

As shown in FIG. 1 and FIG. 2, at least one locking part 21 is disposed on the edge of the corrective lens body 20. A periphery of the frame 12 of the diving mask 10 is arranged with a plurality of locked parts 15 each of which is corresponding to and locked with the locking part 21 of the corrective lens body 20.

By the locking part 21 and the locked part 15 being locked with each other, the corrective lens body 20 is stacked over the outer surface of the lens 11 of the diving mask 10 correspondingly (from the diver's point of view). Moreover, the corrective lens body 20 can also be mounted in an outer frame 22 for use and the locking part 21 is formed on the outer frame 22.

Refer to FIG. 1 and FIG. 2, the locking part 21 of the corrective lens body 20 includes a hooked fastener 211 corresponding to and fastened with the locked part 15 of the frame 12 of the diving mask 10. Thus the corrective lens body 20 and the diving mask 10 are connected firmly and stably, not easily falling off.

The Second Embodiment

Figure 3:
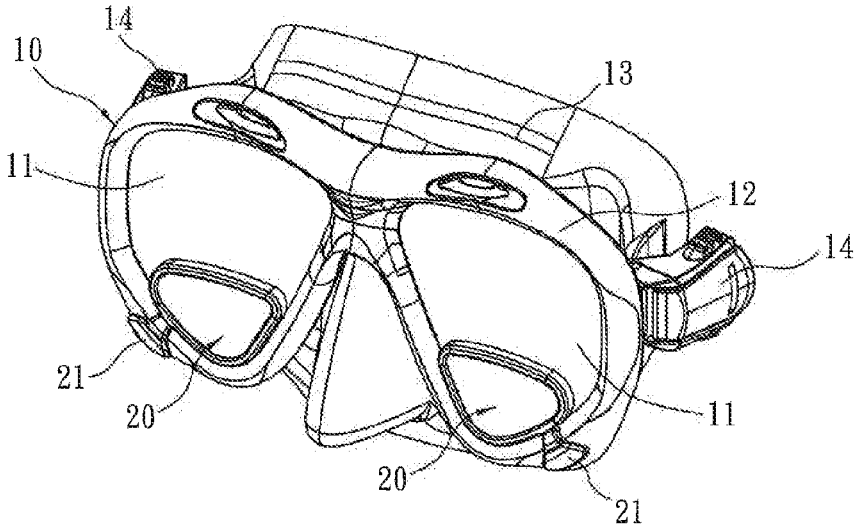
FIG. 3 is a perspective view of another assembled embodiment of corrective lenses for diving masks according to the present invention.
Figure 4:
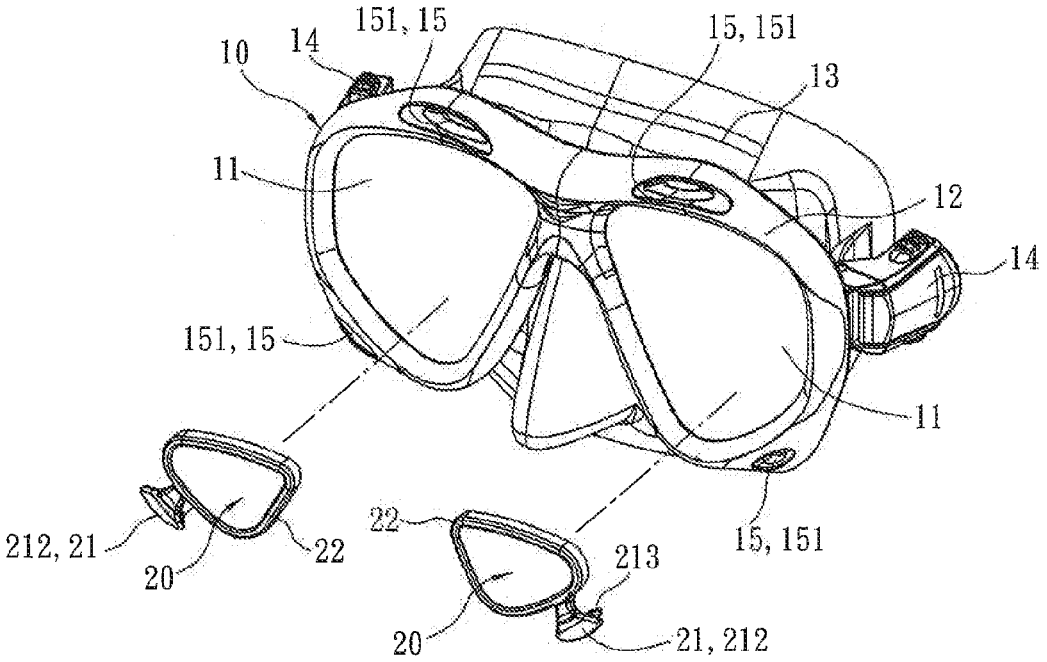
FIG. 4 is a partial explosive view of the embodiment in FIG. 3.
Figure 5:
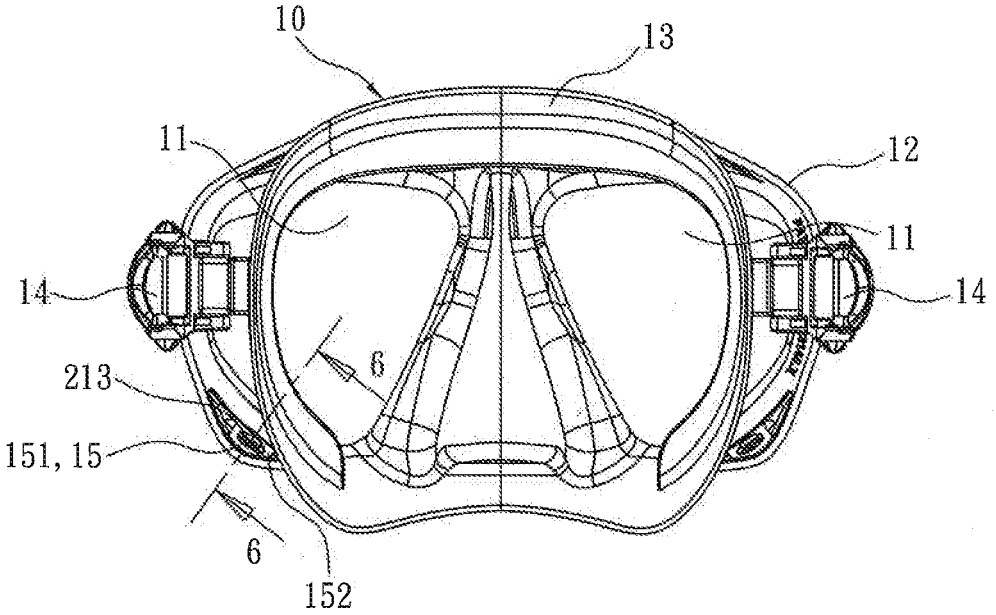
FIG. 5 is a rear view of the embodiment in FIG. 3.
Figure 6:
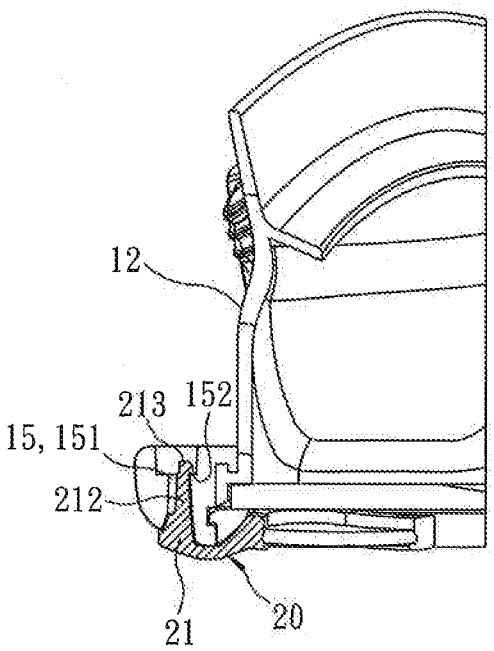
FIG. 6 is an enlarged cross sectional view along a line 6-6 of the embodiment in FIG. 5.

Refer from FIG. 3 and FIG. 6, this embodiment has the structure similar to that of the above embodiment but the difference is in that each locked part 15 includes a mounting slot 151 with a stopping surface 152. The mounting slot 151 penetrates the frame 12 of the diving mask 10. The stopping surface 152 is disposed on an inner end of the mounting slot 151. Moreover, the locking part 21 of the corrective lens body 20 is formed by a positioning mounting body 212 and a projecting block 213 projecting from one end of the positioning mounting body 212. While being assembled, the positioning mounting body 212 is mounted into the mounting slot 151. The projecting block 213 is extended out of the mounting slot 151 and reversely against the stopping surface 152. There is certain tightness between the positioning mounting body 212 and the mounting slot 151 so that they are not easily separated from each other.

The Third Embodiment

Figure 7:
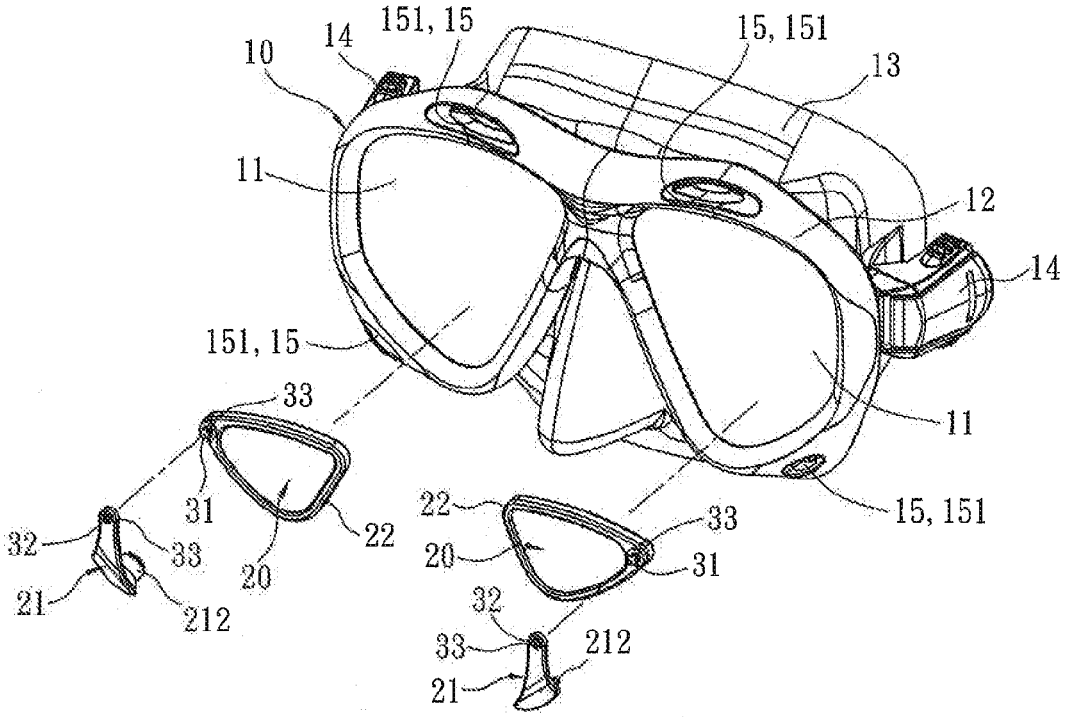
FIG. 7 is an explosive view of a further embodiment of corrective lenses for diving masks according to the present invention.
Figure 8:
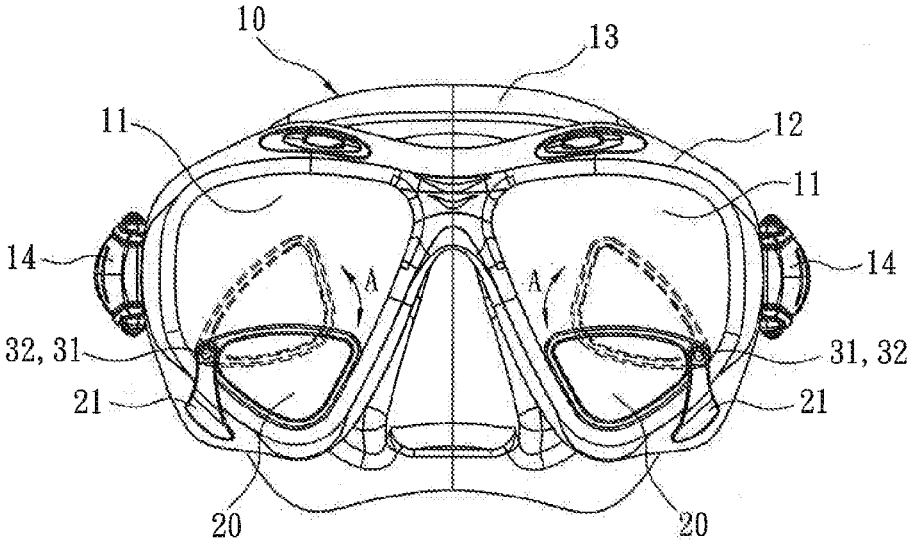
FIG. 8 is a front view of the embodiment in FIG. 7 showing corrective lenses being rotated in relative to a diving mask.

Refer to FIG. 7 and FIG. 8, the difference between this embodiment and the second embodiment is in that the locking part 21 and the corrective lens body 20 are pivotally connected to each other. A connecting surface of the corrective lens body 20 and a connecting surface of the locking part 21 are respectively disposed with a pivot shaft 31 and a pivot hole 32. The pivot shaft 31 and the pivot hole 32 are connected and rotated in relative to each other. The position of the pivot shaft 31 and the position of the pivot hole 32 can be interchanged. The pivot shaft 31 is arranged at the locking part 21 while the pivot hole 32 is set on the corrective lens body 20 (not shown in figure). While in use, the corrective lens body 20 is rotated around the pivot hole 32 in relative to the locking part 21, as the arrow A in FIG. 8 indicated. Thus the corrective lens body 20 is rotated horizontally in relative to the surface of the lens 11 of the diving mask 10.

Moreover, the contact surface of the pivot shaft 31 and the contact surface of the pivot hole 32 are disposed with a toothed structure 33 respectively. The toothed structure 33 includes a plurality of racks arranged uniformly and engaged correspondingly. The rotation angle of the corrective lens body 20 in relative to the locking part 21 is controlled according to a pitch of the toothed structure 33. The toothed structure 33 can also provide positioning function. By the pivot, the corrective lens body 20 can be rotated horizontally and adjusted in relative to the surface of the lens 11 of the diving mask 10. Thus users can enjoy a full range of sight under the water.

The Fourth Embodiment

Figure 9:
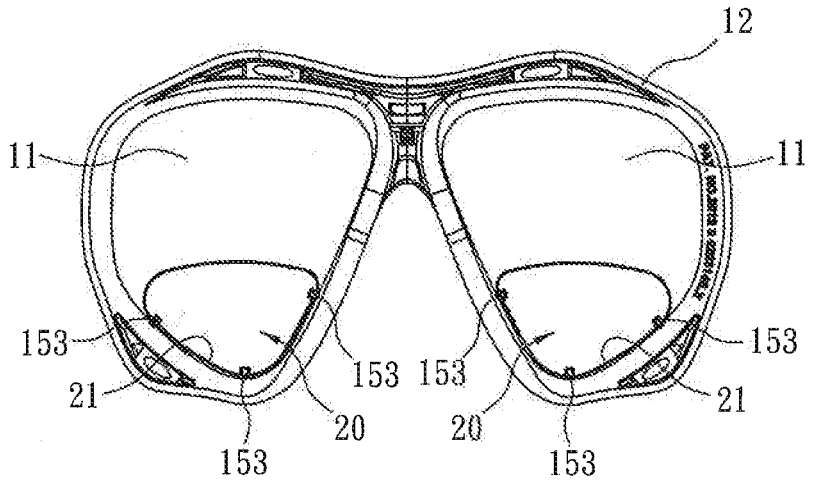
FIG. 9 is a rear view of a further embodiment of corrective lenses for diving masks according to the present invention.

As shown in FIG. 9, the difference of this embodiment and the first embodiment is in that the locked parts 15 of the diving mask 10 are disposed on an edge of an inner side of the frame. 12 of the diving mask 10, around the periphery of the frame 12. Each locked part 15 in the first embodiment is a fastener 153 projecting from the edge of the inner side of the periphery of the frame 12. The locking part 21 of the corrective lens body 20 is locked with the fastener 153. By the fastener and the locking part connected to each other, the corrective lens body 20 and the diving mask 10 are connected tightly, unable to move freely or fall off easily. In this embodiment, the corrective lens body 20 is corresponding to and disposed over an inner surface of the lens 11 of the diving mask 10 (from the diver's point of view).

Figure 10:
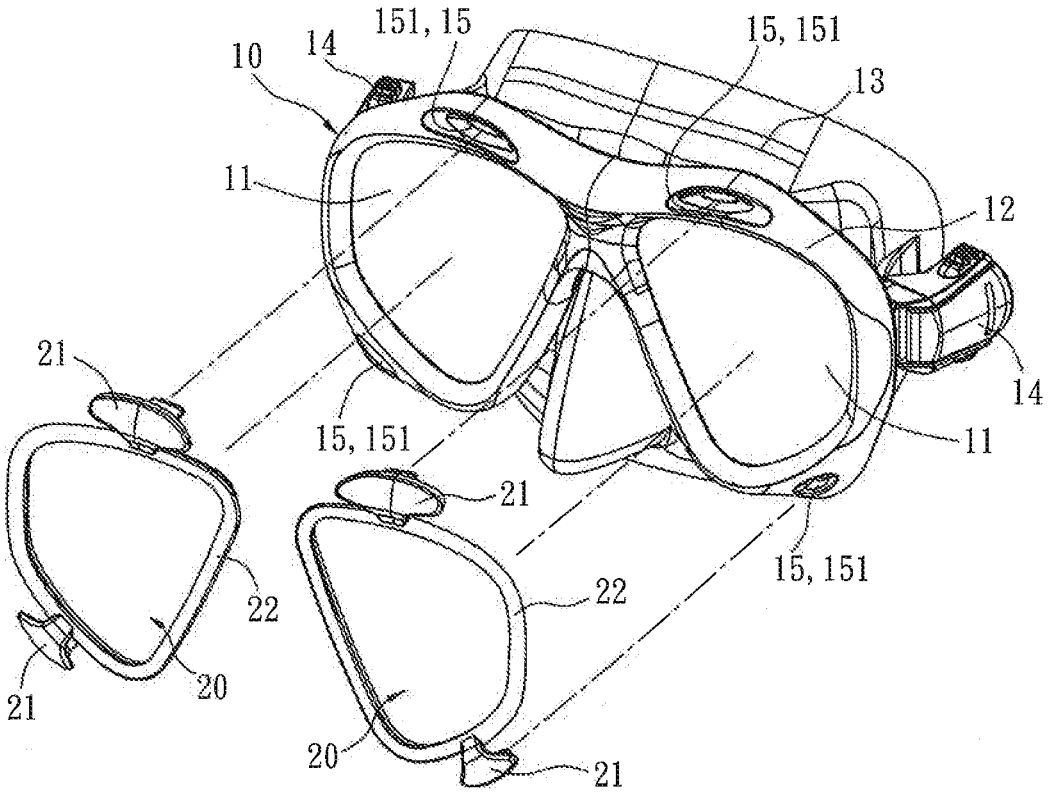
FIG. 10 is an explosive view of a further embodiment of corrective lenses for diving masks showing a corrective lens body of a corrective lens whose area is equal to the area of a lens of a diving mask according to the present invention.
Figure 11:
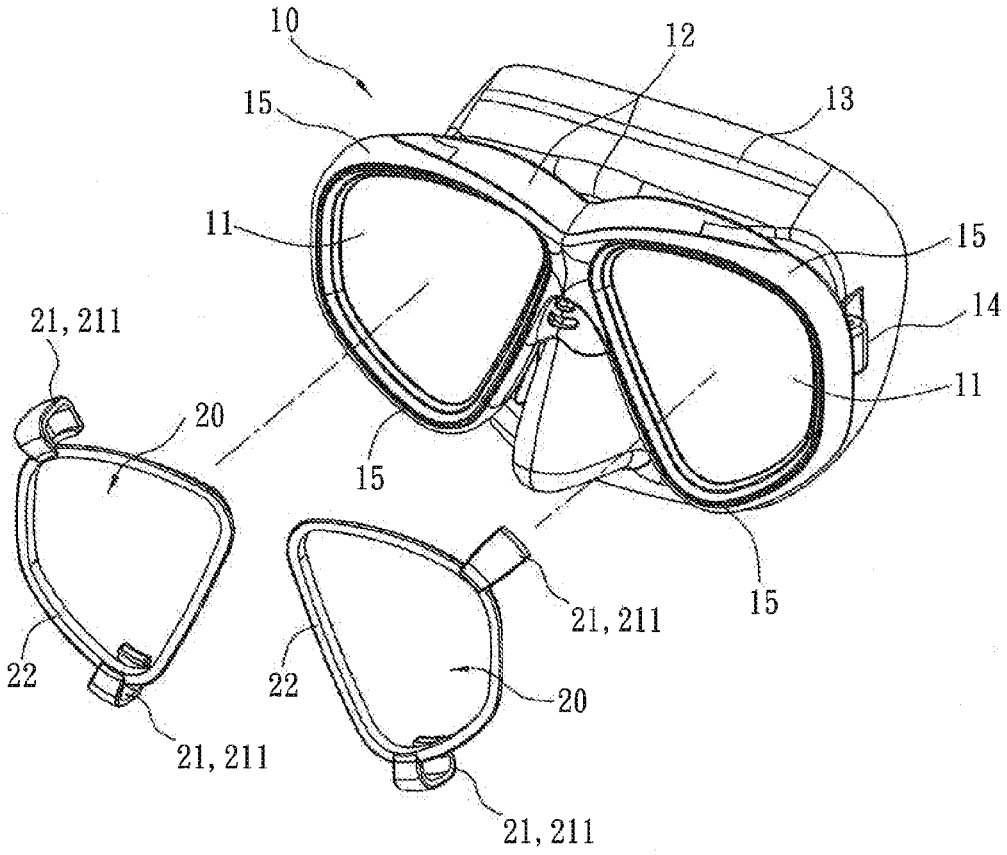
FIG. 11 is an explosive view of another embodiment of corrective lenses for diving masks showing a corrective lens body of a corrective lens whose area is equal to the area of a lens of a diving mask according to the present invention.

In the above embodiments, the area of the corrective lens body 20 is smaller than the area of the lens 11 of the diving mask 10 so that the corrective lens body 20 only covers a part of the surface of the lens 11. Moreover, as shown in FIG. 10 and FIG. 11, the area of the corrective lens body 20 is equal to the area of the lens 11 of the diving mask 10. Thus the corrective lens body 20 can cover the whole surface of the lens 11.

In summary, the corrective lens of the present invention can be used without changing the structure of the diving mask. That means the connection between the lens 11 of the diving mask 10 and the frame 12/or the mask 13 is not detachable. Thus there is no water leaking problem or increasing cost problem caused by design for improving waterproof performance. Moreover, the locking part 21 of the corrective lens body 20 and the locked part 15 of the diving mask 10 can be assembled and disassembled with each other conveniently. Thus users can select different combinations of the corrective lens body 20 and the diving mask 10 freely according to their needs. Thus the corrective lens for diving masks of the present invention is used more safely and conveniently. While the corrective lens body 20 is removed from the diving mask 10, the diving mask 10 can be worn and used by users with normal vision as general diving masks.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A corrective lens for diving masks comprising:

at least one corrective lens body in which at least one locking part is disposed on an edge of thereof; the locking part having at least one hooked fastener; and a diving mask having lenses and a frame for mounting the lenses; a plurality of locked parts is arranged at a periphery of the frame and the locked part is locked with the locking part correspondingly;

wherein the corrective lens body is stacked over an outer surface of the lens of the diving mask by the hooked fastener of the locking part being locked with the locked part.

2. The device as claimed in claim 1, wherein the corrective lens body is selected from the group consisting of a minus lens, a plus lens, a reading lens, and their combinations.

3. The device as claimed in claim 1, wherein the corrective lens body further includes an outer frame; the corrective lens is mounted in an outer frame and the locking part of the corrective lens body is formed on the outer frame.

4. The device as claimed in claim 1, wherein an area of the corrective lens body is smaller than an area of the lens of the diving mask.

5. The device as claimed in claim 1, wherein both shape and area of the corrective lens body are the same as shape and area of the lens of the diving mask.

6. A corrective lens for diving masks comprising:

at least one corrective lens body in which at least one locking part is disposed on an edge of thereof; the locking part having at least one positioning mounting body; and a diving mask having lenses and a frame for mounting the lenses; a plurality of locked parts is arranged at a periphery of the frame and the locked part is locked with the locking part correspondingly; each of the locked parts includes at least one mounting slot which is mounted with the positioning mounting body of the locking part;

wherein the corrective lens body is stacked over an outer surface of the lens of the diving mask by the positioning mounting body of the locking part mounted into the mounting slot of the locked part.

7. The device as claimed in claim 6, wherein the corrective lens body is selected from the group consisting of a minus lens, a plus lens, a reading lens, and their combinations.

8. The device as claimed in claim 6, wherein the corrective lens body further includes an outer frame; the corrective lens is mounted in an outer frame and the locking part of the corrective lens body is formed on the outer frame.

9. The device as claimed in claim 6, wherein the corrective lens body is pivotally connected to the locking part; a connecting surface of the corrective lens body and a connecting surface of the locking part are respectively disposed with a pivot shaft and a pivot hole so that the corrective lens body is able to be rotated horizontally in relative to a surface of the lens of the diving mask by the pivot shaft and the pivot hole connected and rotated in relative to each other.

10. The device as claimed in claim 9, wherein a contact surface of the pivot shaft and a contact surface of the pivot hole are respectively arranged with a toothed structure; the toothed structure includes a plurality of racks disposed uniformly and engaged correspondingly.

11. The device as claimed in claim 6, wherein the mounting slot of the locked part penetrates the frame of the diving mask and a stopping surface is disposed on an inner end of the mounting slot while a projecting block is projecting from one end of the positioning mounting body; While the positioning mounting body of the locking part being mounted into the mounting slot of the locked part, the projecting block is extended out of the mounting slot and reversely against the stopping surface of the mounting slot.

12. The device as claimed in claim 6, wherein an area of the corrective lens body is smaller than an area of the lens of the diving mask.

13. The device as claimed in claim 6, wherein both shape and area of the corrective lens body are the same as shape and area of the lens of the diving mask.

14. A corrective lens for diving masks comprising:

at least one corrective lens body in which at least one locking part is disposed on an edge of thereof; and a diving mask having lenses and a frame for mounting the lenses; a plurality of locked parts is arranged at a periphery of the frame and the locked part is locked with the locking part correspondingly; each of the locked parts is disposed on an inner side of the frame of the diving mask and projecting from the inner side of the frame to form a fastener;

wherein the corrective lens body is stacked over an inner surface of the lens of the diving mask by the locking part locked with the fastener of the locked part.

15. The device as claimed in claim 14, wherein the corrective lens body is selected from the group consisting of a minus lens, a plus lens, a reading lens, and their combinations.

16. The device as claimed in claim 14, wherein an area of the corrective lens body is smaller than an area of the lens of the diving mask.

17. The device as claimed in claim 14, wherein both shape and area of the corrective lens body are the same as shape and area of the lens of the diving mask.

* * * * *